US005307080A

United States Patent [19]

Okumura

[11] Patent Number: 5,307,080

[45] Date of Patent: Apr. 26, 1994

[54] EXPANSIBLE ANTENNA APPARATUS

[75] Inventor: Minoru Okumura, Kawasaki, Japan

[73] Assignee: Kabushiki Kaisha Toshiba, Kawasaki, Japan

[21] Appl. No.: 966,406

[22] Filed: Oct. 26, 1992

[30] Foreign Application Priority Data

Oct. 31, 1991 [JP] Japan ..... 3-286236

[51] Int. Cl.[5] ..... H01Q 15/20

[52] U.S. Cl. ..... 343/915; 343/912

[58] Field of Search ..... 343/915, 912, 914, 913; 52/111, 646, 645; H01Q 15/20

[56] References Cited

U.S. PATENT DOCUMENTS

| | | | |
|---|---|---|---|
| 3,699,576 | 10/1972 | Hoyer | 343/915 |
| 4,030,103 | 6/1977 | Campbell | 343/915 |
| 4,090,204 | 5/1978 | Farhat | 343/915 |
| 4,475,323 | 10/1984 | Schwartzberg et al. | 343/915 |
| 4,571,594 | 2/1986 | Haupt . | |

FOREIGN PATENT DOCUMENTS 63-30006 2/1988 Japan .

OTHER PUBLICATIONS

Kato, et al., 39th Congress of the International Astronautical Federation, Oct. 1988, pp. 1-14. "Concept of Inflatable Elements Supported by Truss Structure for Reflector Application".

*Primary Examiner*—Donald Hajec
*Assistant Examiner*—Hoanganh Le
*Attorney, Agent, or Firm*—Oblon, Spivak, McClelland, Maier & Neustadt

[57] ABSTRACT

An antenna apparatus includes a power converting section which receives microwave energy and converts it to DC power. An actuator for folding/unfolding a mirror-supporting member and an actuator for adjusting the configuration of an antenna reflection mirror are driven and controlled by the DC power supplied from the power converting section.

9 Claims, 4 Drawing Sheets

EXPANSIBLE ANTENNA APPARATUS

BACKGROUND OF THE INVENTION

1. Field of the Invention

This invention relates to an expansible antenna apparatus adapted to be mounted on a spacecraft such as an artificial satellite and constructed in outer space.

2. Description of the Related Art

Research and development carried out in the field of space technology have resulted in the creation of the expansible antenna apparatus comprising an antenna reflection mirror which is folded while on earth and unfolded in outer space, since the former configuration is required for ease of launching into space. A proposed expansible antenna apparatus has an antenna reflection mirror formed of a flexible conductive film, which is attached to an expansible mirror-supporting member. In such a case, the mirror surface accuracy of an antenna reflection mirror must be kept in a range of about 1/50 to 1/100 of the wavelength used (the r.m.s. value of the entire mirror surface).

Hence, it is essential that the expansible antenna be able to fold and unfold with high reliability and accuracy. In addition, expansion errors in the case of the antenna reflection mirror and accuracy errors in the mirror surface, both stemming from heat deformation caused by changes in temperature in the outer space environment must be controlled and the required mirror surface accuracy maintained.

However, since, in the type of expansible antenna apparatus as described above, components such as the mirror-supporting member are remote-controlled, this results in various troubles.

For example, the above antenna apparatus requires the provision of a relatively large number of connection cables between the power source system and actuators for unfolding the antenna apparatus and adjusting the mirror surface. Therefore, when the mirror-supporting member is in the process of being folded or unfolded, there is a possibility of the connection cables being interwound with the mirror-supporting member and the like, making it difficult or impossible to fold or unfold the antenna and thus adversely affecting the apparatus' performance.

SUMMARY OF THE INVENTION

An object of the present invention is to provide an expansible antenna apparatus wherein the antenna unfolding can be performed reliably and mirror surface adjustment operations can be performed accurately, using a simple structure.

The above object can be achieved by an expansible antenna apparatus comprising:

a foldable/unfoldable antenna reflection mirror;

a foldable/unfoldable mirror-supporting mechanism for supporting the antenna reflection mirror;

a folding/unfolding actuator for folding/unfolding the mirror-supporting mechanism to fold/unfold the antenna reflection mirror., power converting means for converting externally-transmitted microwave energy to power and supplying it to the actuator; and control means for driving the actuator in response to a command signal to fold/unfold the mirror-supporting mechanism.

DETAILED DESCRIPTION OF THE PREFERRED EMBODIMENTS

An embodiment of the present invention will now be described in detail with reference to the accompanying drawings.

Figure 1:
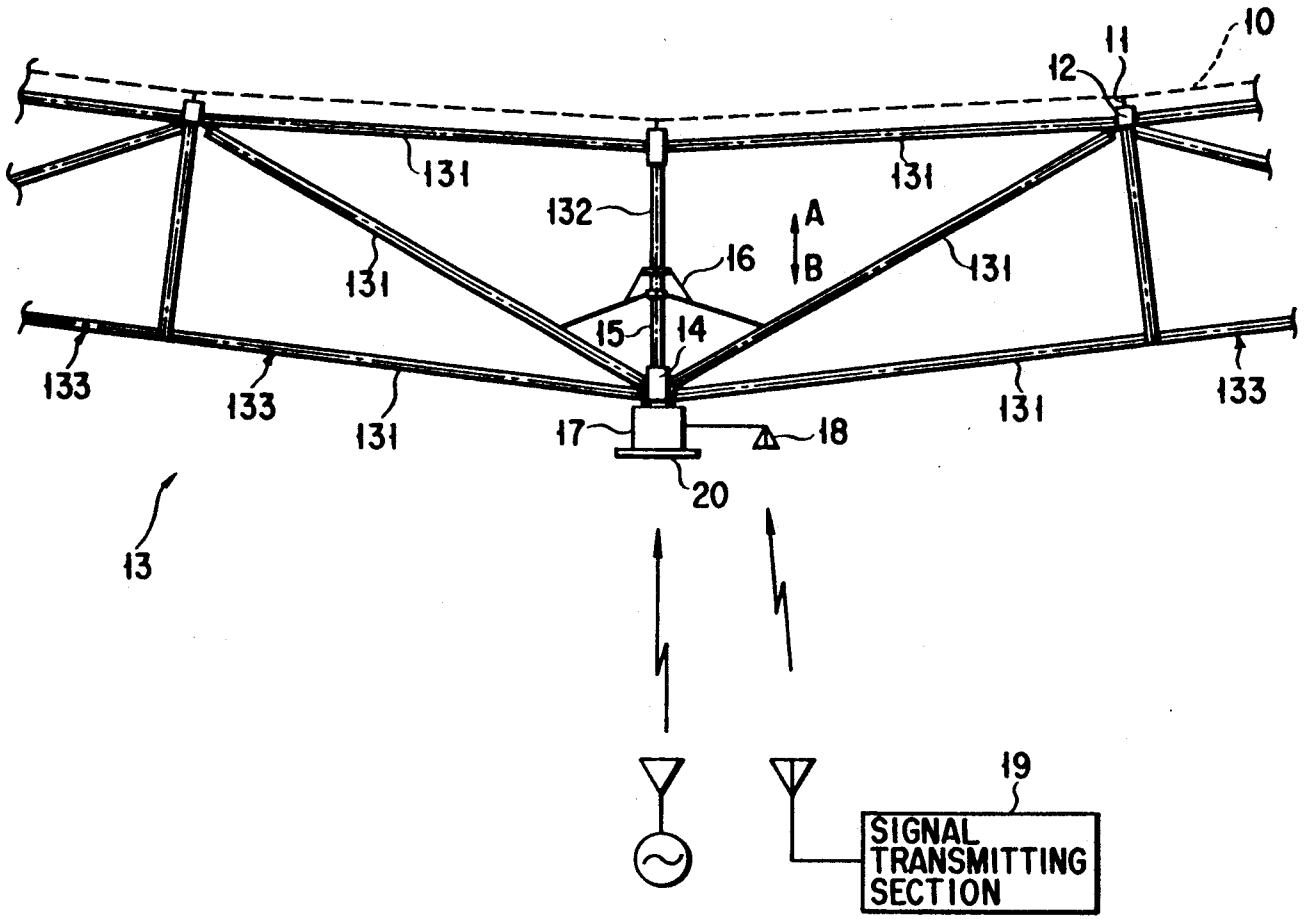
FIG. 1 is a plan view showing an expansible antenna apparatus according to an embodiment of the present invention.
Figure 2:
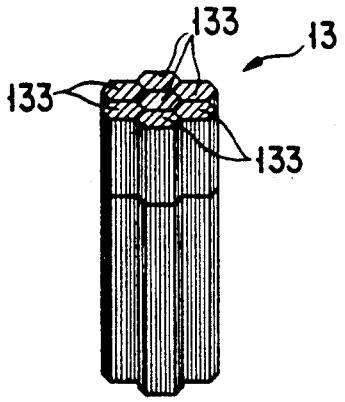
FIGS. 2 and 3 are perspective views showing the mirror-supporting member shown in FIG. 1.
Figure 3:
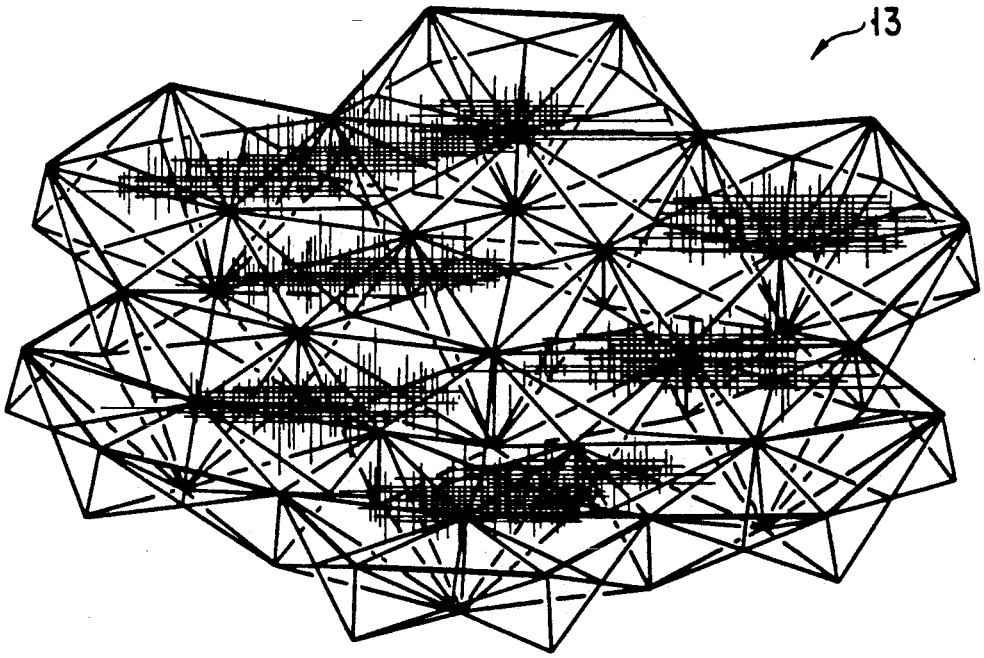

FIG. 1 shows an expansible antenna apparatus according to an embodiment of the present invention. The apparatus has a mesh antenna reflection mirror formed of, for example, a flexible conductive film. The back surface of the antenna reflection mirror 10 is supported by a plurality of mirror-adjusting actuators 12 ($12_1$. . . $12_n$) through supporting elements 11 ($11_1$ . . . $11_n$). The actuators 12 are positioned at predetermined portions of a foldable/unfoldable mirror-supporting member 13. The mirror supporting member 13 is constituted by seven three-dimensional trussings 133, as shown in FIGS. 2 and 3. In each trussing 133, lateral truss members 131 are radially coupled to a longitudinal truss member 132. The foldable/unfoldable mirror-supporting member 13 is mounted on, for example, a spacecraft body (not shown). Each trussing 133 has a folding/unfolding actuator 14 ($14_1$ to $14_7$) at the portion where the lateral truss members 131 are coupled to the longitudinal truss member 132. The trussings 133 are respectively folded and unfolded by the actuators 14.

Figure 4:
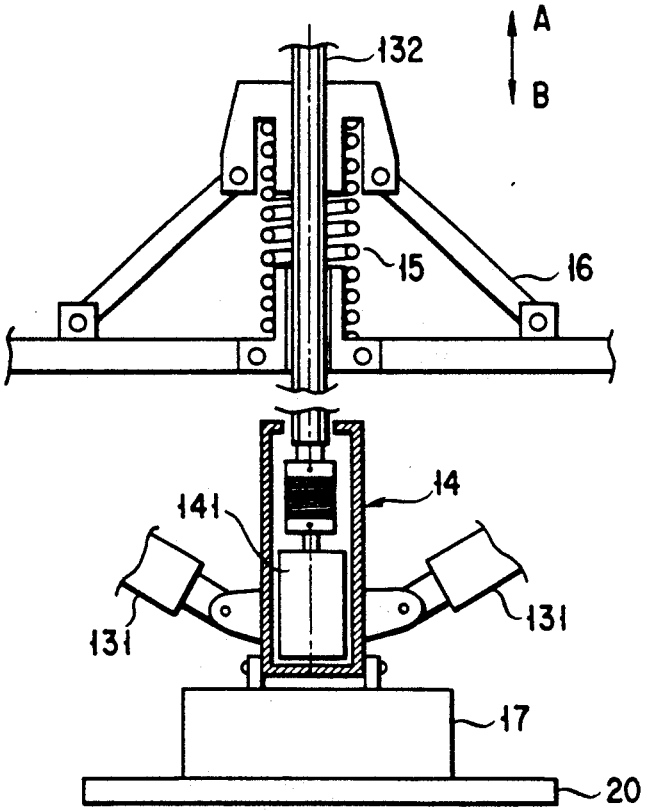
FIG. 4 is a cross-sectional view showing a folding-/unfolding actuator shown in FIG. 1.

More specifically, the folding/unfolding actuator 14 includes a driving motor 141 as shown in FIG. 4. A well-known ball screw mechanism 15 is provided between the axis of rotation of the motor 141 and the longitudinal truss member 132. The base of a well-known umbrella mechanism 16 is engaged with the ball screw mechanism 15 so as to be movable up and down in directions indicated by the arrows A and B. End portions of the lateral truss members 131 are coupled with the umbrella mechanism 16. The trussing 133 is folded or unfolded in the following manner: when the ball screw mechanism 15 is rotated by the motor 141 of the actuator 14, the umbrella mechanism 16 is moved up and down in the directions of the arrows A and B along the ball screw mechanism 15, thereby rotating the lateral truss members 131 with respect to the longitudinal truss member 132. When the seven trussings 133 are folded or unfolded in this manner, the entire structure of the mirror supporting member 13 is folded or unfolded on the spacecraft body.

Figure 5:
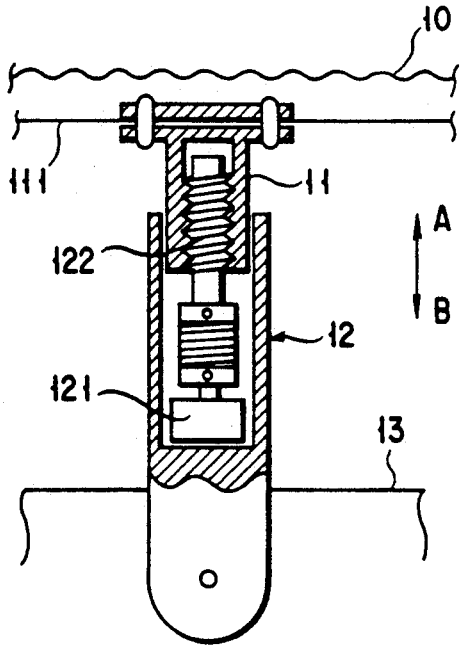
FIG. 5 is a cross-sectional view showing a mirror-adjusting actuator shown in FIG. 1.

The mirror-adjustment actuator 12 includes a driving motor 121 as shown in FIG. 5. The rotation axis of the motor 121 is connected to the supporting element 11 via a screw mechanism 122. When the motor 121 of the actuator 12 is driven, the screw mechanism 122 is rotated, thereby moving the supporting element 11 up and down in the directions indicated by the arrows A and B. The mirror surface of the antenna reflection mirror 10 is controlled in accordance with the movement of the supporting element 11. The supporting elements 11 on the mirror supporting member 13 are coupled with one another through a wire member 111 to adjust the antenna reflection mirror 10 to a predetermined form.

The mirror supporting member 13 includes a control section 17. A signal input terminal of the control section 17 is connected to a receiving section 18 for receiving a control signal. The control section 17 receives a folding control signal, an unfolding control signal, and a mirror-adjusting control signal through the receiving section 18 from a signal transmitting section 19. The signal transmitting section 19 is mounted on, for example, the spacecraft body.

The folding and unfolding control signals are transmitted from the signal transmitting section 19 to the receiving section 18 of the control section 17 based on a command signal supplied from the earth, when the spacecraft reaches outer space.

The mirror-adjusting control signal is generated on the basis of a measured value, which is obtained by measuring the mirror surface accuracy of the antenna reflection mirror 10 after unfolded, by a well known measuring means. The mirror-adjusting control signal is also transmitted from the signal transmitting section 19 to the receiving section 18 of the control section 17.

Figure 6:
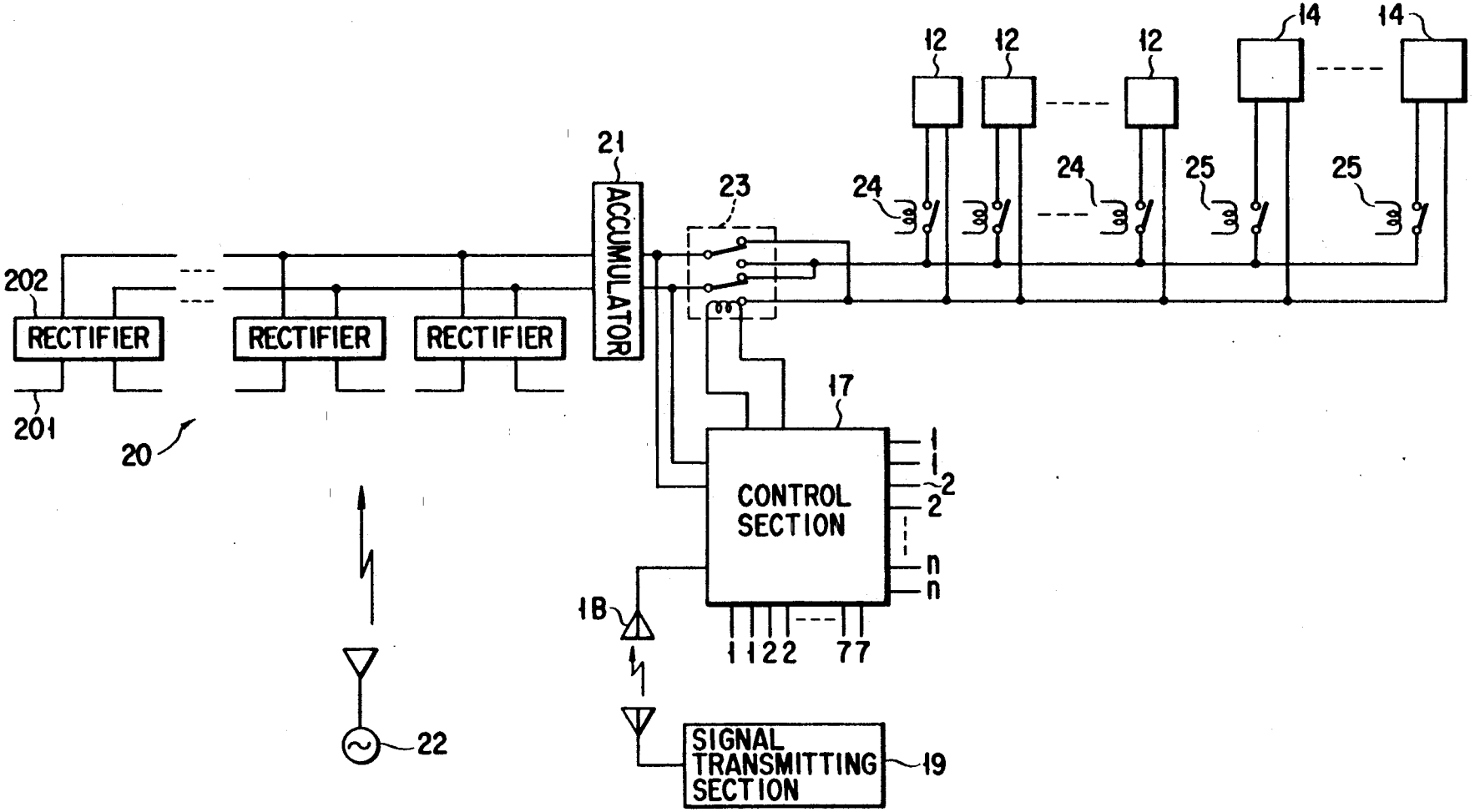
FIG. 6 is a circuit diagram of the apparatus shown in FIG. 1.

A power input terminal of the control section 17 is connected to an output terminal of a power converting section 20 formed of the known rectena element. The power converting section 20 is constituted by a receiving antenna section 201 and a plurality of rectifiers 202, as shown in FIG. 6. An accumulator 21 is provided in the stage subsequent to the rectifiers 202.

The power converting section 20 receives, through the receiving antenna section 201, microwave energy supplied from a microwave transmitter 22 provided outside the spacecraft body. The received microwave energy is converted to a DC power by the rectifiers 202 and accumulated in the accumulator 21. The DC power accumulated in the accumulator 21 is supplied to the control section 17 to operate it.

The microwave transmitter 22 need not be provided in the spacecraft on which the antenna reflection mirror 10 is mounted. For example, it may be mounted on another spacecraft and microwave energy may be transmitted therefrom to the power converting section 20.

Output terminals of the accumulator 21 are connected to the actuators 12 and 14 through a forward-/reverse switch 23 and an on/off switches 24 ($24_1$ to $24_n$) and 25($25_1$ and $25_7$ ). Signal output terminals of the control section 17 are connected to signal input terminals of the forward/reverse switch 23 and the on/off switches 24 and 25.

The forward/reverse switch 23 is selectively controlled in response to a switching signal output from the control section 17 to control the driving directions of the actuators 12 and 14. The on/off switches 24 and 25 are selectively on/off-controlled in response to a switching signal output from the control section 17 to drive and control desired actuators 12 and 14.

In the above structure, the power converting section 20 receives microwaves from the microwave transmitter 22, converts them to DC power, and output it to the control section 17, the forward/reverse switch 23 and the on/off switches 24 and 25. When the control section 17 receives a folding or unfolding control signal from the signal transmitting section 19, it generates a switch signal based on the control signal and outputs it to signal input terminals of the forward/reverse switch 23 and the on/off switches 25. As a result, the forward/reverse switch 23 is switch-controlled to set the driving direction of the actuator 14 in accordance with the folding or unfolding operation. At the same time, the control section 17 turns on the on/off switch 25 and drives the actuator 14 in a direction indicated by the arrow A or B. As a result, the trussing 133 is folded or unfolded as described above, and accordingly the mirror supporting member 13 is folded or unfolded on the spacecraft.

The mirror surface of the antenna reflection mirror 10 is adjusted as follows. In a state where the mirror supporting member 13 is unfolded, the measuring means measure the mirror surface accuracy of the antenna reflection mirror 10. A mirror-adjusting control signal is generated in accordance with the mirror surface accuracy, and transmitted to the control section 17 through the signal transmitting section 19. The control section 17 generates a switch signal based on the control signal, which is output to the signal input terminals of the forward/reverse switch 23 and the on/off switch 24. The forward/reverse switch 23 sets the driving directions of the actuators 12 in accordance with the switch position. The on/off switch 24 selectively drives the actuators 12 in accordance with the on/off states. As a result, the supporting element 11 is moved up and down in the directions A and B as described above, so that the shape of the antenna reflection mirror 10 is controlled.

As has been described above, the expansible antenna apparatus has the power converting section 20 for converting externally transmitted microwave energy to DC power. The actuators 14 for folding/unfolding the mirror supporting member 13 and the actuators 12 for controlling the shape of the antenna reflection mirror 10 are driven and controlled by the DC power output from the power converting section 20. If, for example, seven power converting sections 20 as a power source system are respectively connected to the seven trussings 133 which constitute the mirror supporting member 13, the connection cable circuit for connecting the actuators 12 and 14 and the control section 17 is completed in each of the trussings 133. Thus, since it is unnecessary to connect the trussings 133 with one another by a connection cable, the number of connection cables required in the antenna apparatus is reduced as compared to a conventional apparatus. As a result, during operations of folding/unfolding the mirror supporting member 13 and adjusting the surface of the antenna refection mirror 10, adverse influence of the connection cables to these operations is reduced. Accordingly, reliable and accurate folding/unfolding and mirror-adjusting operation can be achieved.

In the above embodiment, the accumulator 21 is provided in the stage subsequent to the rectifiers 202 of the power converting section 20 in order to accumulate DC power and supply it to the elements of the apparatus. However, the DC power output from the power conversion section may directly be supplied to the control section 17 and the like.

Further, in the above embodiment, the mirror supporting member 13 is constituted by the seven trussings 133, each having a longitudinal truss member 132 and lateral truss members 131 radially connected thereto. However, the mirror supporting member 13 is not limited to the above structure, but may be constituted by cubic foldable/unfoldable trussings of various sizes.

The present invention is not limited to the above embodiment but various modifications may be made within the spirit and scope of the invention.

What is claimed is:

1. An expansible antenna apparatus comprising:

a foldable/unfoldable antenna reflection mirror;

a foldable/unfoldable mirror-supporting mechanism for supporting said foldable/unfoldable antenna reflection mirror;

a folding/unfolding actuator for folding/unfolding said foldable/unfoldable mirror-supporting mechanism to fold/unfold said foldable/unfoldable antenna reflection mirror;

power converting means, including a reception section which receives externally-transmitted microwaves, for converting energy of said microwaves received at said reception section into electrical power and for supplying said electrical power to said folding/unfolding actuator; and control means for driving said folding/unfolding actuator in response to a command signal to fold/unfold said foldable/unfoldable mirror-supporting mechanism.

2. An expansible antenna apparatus according to claim 1, wherein said foldable/unfoldable antenna reflection mirror is formed of a flexible conductive film.

3. An expansible antenna apparatus according to claim 1, wherein said power converting means includes an accumulating section for accumulating converted electrical power and supplying said converted electrical power to said folding/unfolding actuator.

4. An expansible antenna apparatus comprising:

a foldable/unfoldable antenna reflection mirror;

a foldable/unfoldable mirror-supporting mechanism for supporting said foldable/unfoldable antenna reflection mirror;

a mirror-adjusting actuator for adjusting a mirror surface of said foldable/unfoldable antenna reflection mirror;

power converting means, including a reception section which receives externally-transmitted microwaves, for converting energy of said microwaves received at said reception section into electrical power and for supplying said electrical power to said mirror-adjusting actuator; and control means for driving said mirror-adjusting actuator in response to a command signal to adjust a configuration of said foldable/unfoldable antenna reflection mirror.

5. An expansible antenna apparatus according to claim 4, wherein said foldable/unfoldable antenna reflection mirror is formed of a flexible conductive film.

6. An expansible antenna apparatus according to claim 4, wherein said power converting means includes an accumulating section for accumulating converted electrical power and supplying said converted electrical power to said mirror-adjusting actuator.

7. An expansible antenna apparatus comprising:

a foldable/unfoldable antenna reflection mirror;

a foldable/unfoldable mirror-supporting mechanism for supporting said foldable/unfoldable antenna reflection mirror;

a first actuator for folding/unfolding said foldable/unfoldable mirror-supporting mechanism to fold/unfold said foldable/unfoldable antenna reflection mirror;

a second actuator for adjusting a mirror surface of said foldable/unfoldable antenna reflection mirror;

power converting means, including a reception section which receives externally-transmitted microwaves, for converting energy of said microwaves received at said reception section into electrical power and for supplying said electrical power to said first actuator and to said second actuator; and control means for driving said first actuator and said second actuator in response to a command signal to fold/unfold said foldable/unfoldable mirror-supporting mechanism and to adjust a configuration of said foldable/unfoldable antenna reflection mirror.

8. An expansible antenna apparatus according to claim 7, wherein said foldable/unfoldable antenna reflection mirror is formed of a flexible conductive film.

9. An expansible antenna apparatus according to claim 7, wherein said power converting means includes an accumulating section for accumulating converted electrical power and supplying said converted electrical power to said first actuator and to said second actuator.

* * * * *